United States Patent [19]

Miyagi et al.

[11] 4,392,471

[45] Jul. 12, 1983

[54] METHOD AND APPARATUS FOR CONTROLLING THE AIR-FUEL RATIO IN AN INTERNAL COMBUSTION ENGINE

[75] Inventors: Hideo Miyagi; Jiro Nakano, both of Okazaki, Japan

[73] Assignee: Toyota Jidosha Kogyo Kabushiki Kaisha, Toyota, Japan

[21] Appl. No.: 296,241

[22] Filed: Aug. 24, 1981

[30] Foreign Application Priority Data

Sep. 1, 1980 [JP] Japan ..... 55-119830

[51] Int. Cl.[3] ..... F02B 3/00

[52] U.S. Cl. ..... 123/489; 123/480; 123/438; 123/440

[58] Field of Search ..... 123/489, 480, 438, 440

[56] References Cited

U.S. PATENT DOCUMENTS 4,178,884 12/1979 Norimatsu et al. ..... 123/489
4,248,196 3/1980 Toelle ..... 123/489
4,252,098 2/1981 Tomczak et al. ..... 123/489
4,284,050 8/1981 Schowerskyj et al. ..... 123/489
4,321,903 3/1982 Kondo et al. ..... 123/489

*Primary Examiner*—Parshotam S. Lall
*Attorney, Agent, or Firm*—Cushman, Darby & Cushman

[57] ABSTRACT

The amount of fuel supplied to the engine is corrected in accordance with an air-fuel ratio correction coefficient. When the engine is in a predetermined first operating condition, the correction coefficient is calculated depending upon the detected concentration of a predetermined component in the exhaust gas, and thus the above correction is performed by closed-loop control. When the engine is not in the first operating condition, the correction coefficient is fixed, and thus the above correction is performed by open-loop control. An average value of the calculated correction coefficient is calculated only when the engine is in a predetermined second operating condition. An initial value of the air-fuel ratio correction coefficient when closed-loop control is resumed is determined to be the calculated average value.

22 Claims, 6 Drawing Figures

28
60
CPU
62
CLOCK GENERATOR CIRCUIT
54
A/D
56
SPEED SIGNAL FORMING CIRCUIT
64
IN PUT PORT
70
33
34
44
40a
40b
48a
48b
31
32
42
38
46
O2 SENSOR
AIR-FLOW SENSOR
COOLANT TEMPERATURE SENSOR
CRANK ANGLE SENSOR
THROTTLE SENSOR

80
IS CLOSED-LOOP CONTROL ?
NO
YES
81
READ OUT DETECTION DATA OF $O_2$ SENSOR
82
COMPARE DETECTION DATA
83
IS RICH FLAG "1" ?
NO
YES
84
$f_i(A/F) \leftarrow f_{i-1}(A/F) - \alpha$
85
$f_i(A/F) \leftarrow f_{i-1}(A/F) + \beta$
STORE $f_i(A/F)$
86
87
IS SECOND OPERATING CONDITION ?
NO
YES
88
CALCULATE $F_i$ (A / F)
89
STORE $F_i$ (A/F)
RETURN

METHOD AND APPARATUS FOR CONTROLLING THE AIR-FUEL RATIO IN AN INTERNAL COMBUSTION ENGINE

BACKGROUND OF THE INVENTION

The present invention relates to an air-fuel ratio control method and apparatus for an internal combustion engine.

It is known practice to provide an internal combustion engine with a closed-loop system for controlling the air-fuel ratio, which calculates an air-fuel ratio correction coefficient f(A/F) responsive to detection signals fed from a concentration sensor which detects the concentration of a particular component contained in the exhaust gases, such as from an oxygen concentration sensor (hereinafter referred to as $O_2$ sensor) which detects the concentration of oxygen in the exhaust gas, and which corrects the amount of the fuel injected into the engine relying upon the calculated coefficient. In the internal combustion engine of this type, the air-fuel ratio correction coefficient f(A/F) is fixed to a predetermined value when the engine is under predetermined operating conditions, and the function of closed-loop control is discontinued. For example, the air-fuel ratio correction coefficient f(A/F) is maintained at a constant value irrespective of the detection signals of the $O_2$ sensor when the coolant temperature of the engine is lower than a predetermined value, or when the opening degree of the throttle valve is greater than a predetermined value and thus the rate of feeding the fuel is additionally increased, or when the $O_2$ sensor is inactive, or when the supply of the fuel has been cut off. Accordingly, closed-loop control of the air-fuel ratio, relying upon the detection signals of the $O_2$ sensor is discontinued (the period when closed-loop control has ceased to work is hereinafter referred to as the period of open-loop control). According to the conventional art, the initial value of the air-fuel ratio correction coefficient f(A/F) when closed-loop control is started again after open-loop control is finished, is set to be equal to a fixed value of the air-fuel ratio correction coefficient f(A/F) during open-loop control. Namely, the initial air-fuel ratio correction coefficient f(A/F) when closed-loop control is resumed is selected to be equal to an air-fuel ratio correction coefficient f(A/F) at closed-loop control just before open-loop control, or to be equal to a predetermined value, for example, equal to f(A/F)=1.0.

According to the above former method, however, the initial air-fuel ratio correction coefficient f(A/F) when closed-loop control is resumed is greatly deviated from an optimum value of f(A/F) if closed-loop control just prior to open-loop control was carried out under very particular operation conditions. Thus the coefficient f(A/F) requires considerably extended periods of time to reach an optimum value. Even with the above-mentioned latter method, the optimum coefficient f(A/F) is often greatly derivated from the initial coefficient and thus extended periods of time are needed until the coefficient f(A/F) reaches an optimum value. Furthermore, in case where a so-called rich monitor control is effected, i.e., where closed-loop control forcibly stopped when the coefficient f(A/F) charges by more than a predetermined value over a predetermined period of time, it often happens that the coefficient f(A/F) is not at all permitted to reach the optimum value.

If the coefficient f(A/F) is not allowed to readily reach the optimum value or is not at all allowed to reach the optimum value even after closed-loop control has been resumed, performance for controlling the air-fuel ratio at a desired air-fuel ratio is deteriorated as a matter of course, and the operating characteristics of the engine are deteriorated. Furthermore, the function for purifying the exhaust gas is diminished, as well.

SUMMARY OF THE INVENTION

It is, therefore, an object of the present invention to provide an air-fuel ratio control method and apparatus which is capable of immediately obtaining an optimum air-fuel ratio condition when closed-loop air-fuel ratio control is resumed.

According to the present invention, the concentration of a predetermined component in the exhaust gas in the engine is detected, along with an operating condition of the engine to discriminate whether or not the engine is in a predetermined first operating condition. An air-fuel ratio correction is then calculated depending upon the detected concentration when the engine is in the first operating condition. However, when the engine is not in the first operating condition, the air-fuel ratio correction coefficient is held to a predetermined value. Operation conditions of the engine are monitored to also discriminate whether or not the engine is in a predetermined second operating condition which is included within the first operating condition and an average value of the calculated air-fuel ratio correction coefficient only when the engine is in the second operating condition is calculated. The amount of fuel supplied to the engine is corrected in accordance with the air-fuel ratio correction coefficient, the correcting being performed by a closed-loop control when the engine is in the first operating condition and performed by an open-loop control when the engine is not in the first operating condition. An initial value of the air-fuel ratio correction coefficient when the fuel correction changes from open-loop control to closed-loop control is determined according to the calculated average value.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
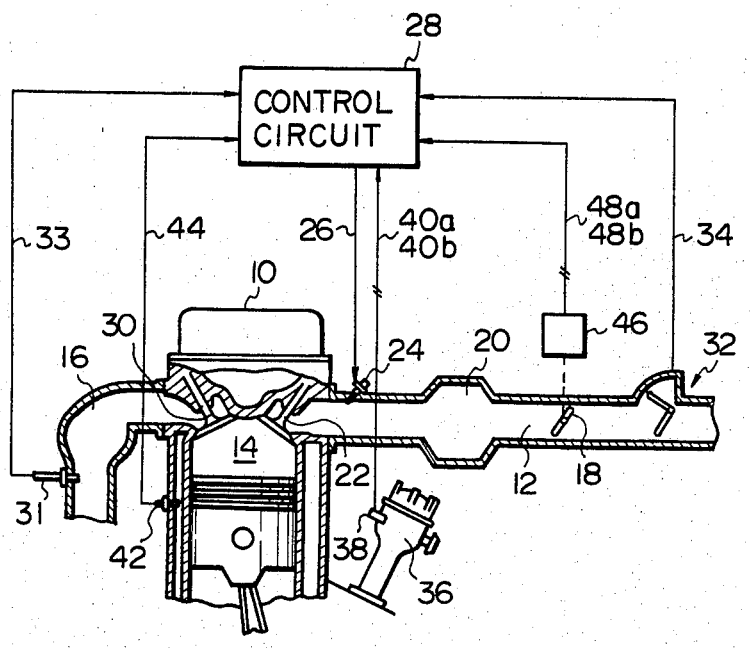
FIG. 1 is a schematic diagram illustrating an air-fuel ratio control system to which the present invention is used.

Referring to FIG. 1, reference numeral 10 denotes an engine, 12 denotes an intake passage, 14 denotes a combustion chamber, and 16 denotes an exhaust passage. The flow rate of the air introduced through the air cleaner, which is not diagrammatized, is controlled by a throttle valve 18 that is interlocked to an accelerator pedal, which is not diagrammatized. The intake air is introduced into the combustion chamber 14 via a surge tank 20 and an intake valve 22. At least one fuel injection valve 24 is installed in the intake passage 12 in the vicinity of the intake valve 22, and is opened and closed responsive to electric drive pulses that are fed from a control circuit 28 via a line 26. The fuel injection valve 24 injects the compressed fuel that is supplied from a fuel supply system, which is not diagrammatized. The exhaust gas, which is produced by the combustion in the combustion chamber 14, is exhausted into the open air through an exhaust valve 30, an exhaust passage 16 and through a catalytic converter, which is not diagrammatized.

An $O_2$ sensor 31 for generating a detection signal which indicates the concentration of the oxygen component in the exhaust gas is disposed in the exhaust passage 16. The detection signal is fed to the control circuit 28 via a line 33.

An air-flow sensor 32 is provided in the intake passage 12 in the upstream of the throttle valve 18. This air-flow sensor 32 detects the flow rate of the air that is taken into the engine and sends an output signal to the control circuit 28 via a line 34.

A crank angle sensor 38 which is installed in a distributor 36 produces pulse signals at every crank angle of 30° and 360°. The pulse signals produced at every crank angle of 30° are fed to the control circuit 28 via a line 40*a*, and the pulse signals produced at every crank angle of 360° are fed to the control circuit 28 via a line 40*b*.

The output signal of a coolant temperature sensor 42 which detects the temperature of the coolant in the engine is fed to the control circuit 28 via a line 44.

A throttle sensor 46 interlocked to the throttle valve 18 produces a full closed signal which indicates whether or not the throttle valve 18 is at the fully closed position, and produces a full open signal which indicates whether or not the throttle valve 18 is opened greater than a predetermined degree which nearly corresponds to the fully open position. The produced full closed signal and full open signal are fed to the control circuit 28 via line 48*a* and 48*b*, respectively.

Figures 2, 2A, 2B:
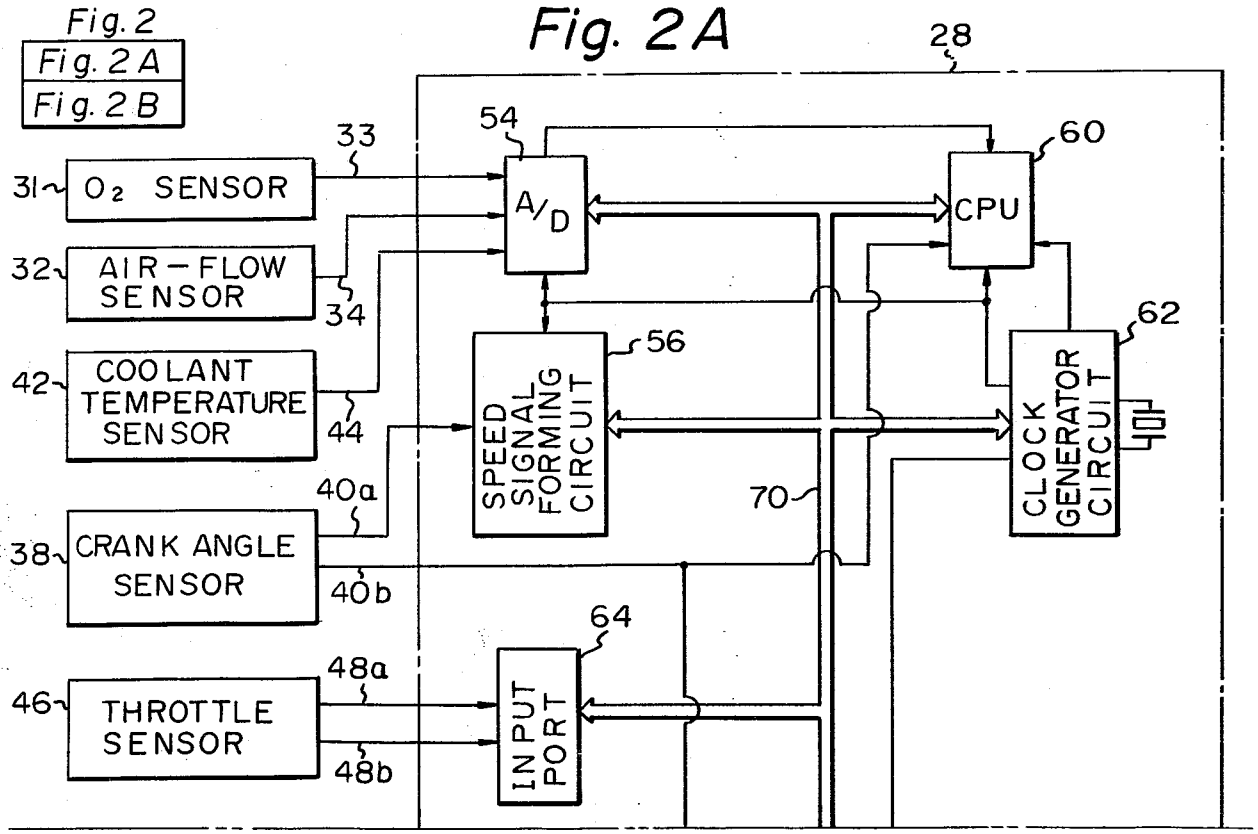
FIG. 2A and 2B are a block diagram illustrating the control circuit shown in FIG. 1.
Figure 2B:
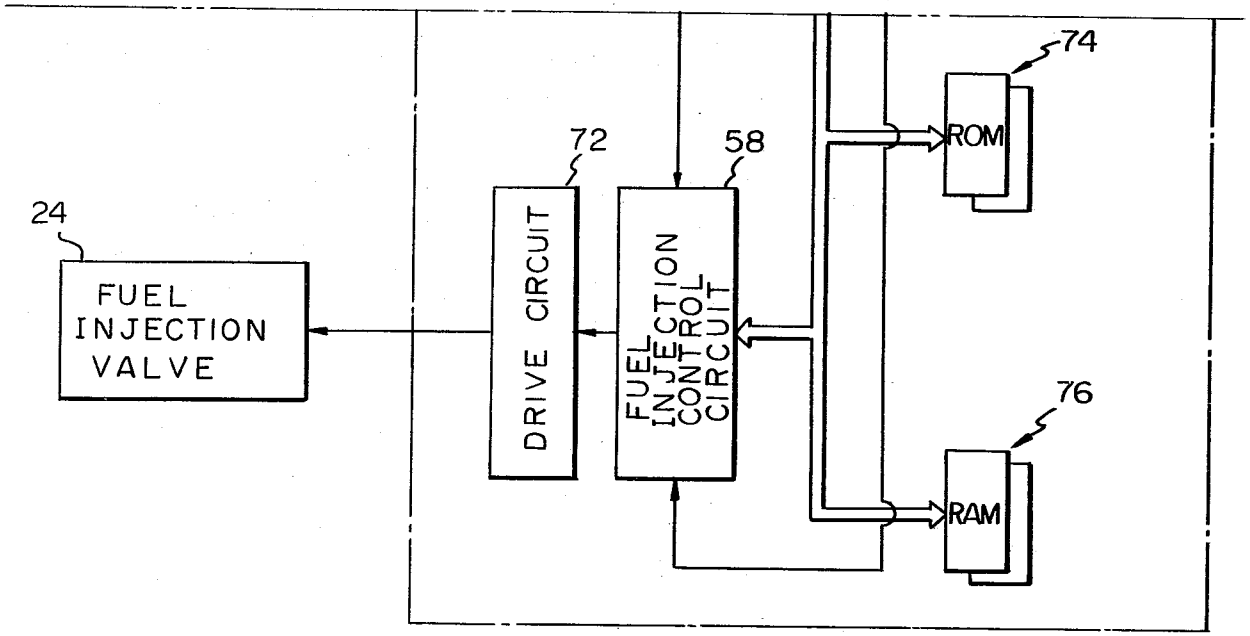

FIG. 2 is a block diagram illustrating the control circuit 28 of FIG. 1, in which the $O_2$ sensor 31, the air-flow sensor 32, the coolant temperature sensor 42, the crank angle sensor 38, the throttle sensor 46 and the fuel injection valve 24 that are illustrated in FIG. 1 are represented by blocks, respectively.

The output signals of the $O_2$ sensor 31, the air-flow sensor 32 and the coolant temperature sensor 42 are fed to an analog-to-digital converter 54, which contains an analog multiplexer, and are converted into signals in the form of binary numbers.

Pulses produced by the crank angle sensor 38 at every crank angle of 30° are fed to a speed signal-forming circuit 56 via the line 40*a*, the pulses produced at every crank angle of 360° are fed, as fuel injection initiation signals, to a fuel injection control circuit 58 via the line 40*b* and are further fed, as interrupt request signals for the fuel injection time arithmetic operation, to a first interrupt input port of a central processing unit (CPU) 60 consisting of microprocessors. The speed signal-forming circuit 56 has a gate which is opened and closed by the pulses produced at every crank angle of 30° and a counter for counting the number of clock pulses which are fed from a clock generator circuit 62 via the gate, and forms a speed signal in the form of a binary number, which corresponds to the rotational speed of the engine.

The full closed signal and the full open signal fed from the throttle sensor 46 are applied to an input port 64 and temporarily stored therein.

A fuel injection control circuit 58 has a presettable down counter and an output register. An output datum, which corresponds to one time of the injection time $\tau$ of the fuel injection valve 24, is sent from the CPU 60 via a bus 70, and is set to the output register. As the pulses (fuel injection initiation signals) produced by the crank angle sensor 38 at every crank angle of 360° are applied, the thus set datum is loaded to the down counter. At the same time, the output of the down counter is inverted to assume a high level, and then the loaded value is subtracted one by one for each application of the clock pulse from the clock generator circuit 62. When the loaded value becomes zero, the output of the down counter is inverted into a low level. Therefore, the output of the fuel injection control circuit 58 becomes an injection signal having a duration which is equal to the injection time $\tau$, and is fed to the fuel injection valve 24 via a drive circuit 72.

The A/D converter 54, the speed signal-forming circuit 56, the input port 64 and the fuel injection control circuit 58 are connected via a bus 70 to the CPU 60, read-only memory (ROM) 74, random access memory (RAM) 76, and clock generator circuit 62, which constitute the microcomputer. Via the bus 70, the input data and output data are transferred. Although not diagrammatized in FIG. 2, the microcomputer is provided with an output port, an input/output control circuit, a memory control circuit, and the like, as is customary. In the ROM 74, there will have been stored beforehand a program of a main processing routine, an interrupt processing program for calculating the air-fuel ratio correction coefficient and for calculating an average value of the coefficient, an interrupt processing program for calculating the fuel-injection pulse-width, other interrupt processing programs, and various data that are necessary for performing the arithmetic calculation.

Below are illustrated the operation of the microcomputer in the control circuit 28 in conjunction with the flow diagrams of FIGS. 3 and 4.

The CPU 60 in the main processing routine introduces the latest data which represents the rotational speed N of the engine from the speed signal-forming circuit 56, and stores it in a predetermined region in the RAM 76. Further, the CPU 60 introduces the latest data which represents the flow rate Q of the intake air sucked into the engine as well as the latest data which represents the coolant temperature W relying upon the interrupt processing routine for A/D conversion which is executed at a predetermined interval of time, and stores them in the predetermined regions in the RAM 76.

Figure 3:
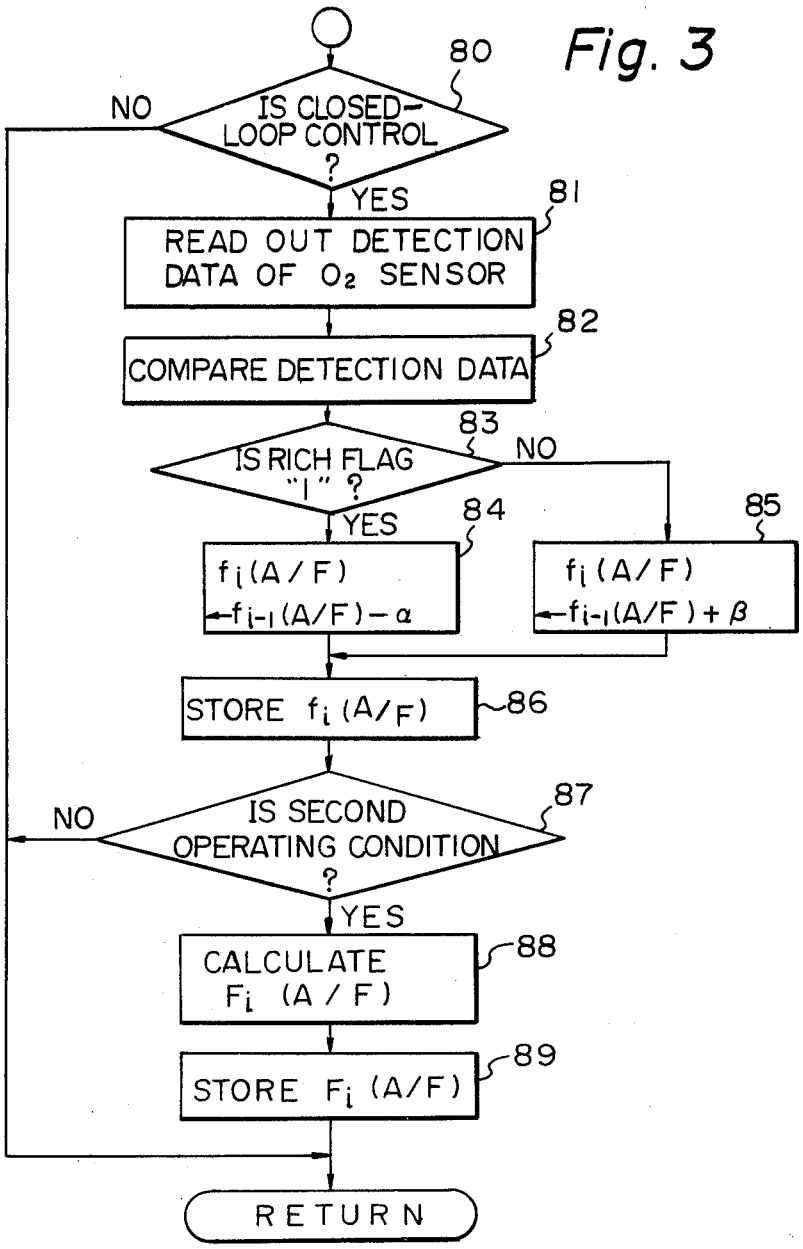
FIGS. 3 and 4 are flow diagrams illustrating the operation of the digital computer in the control circuit shown in FIG. 2.

Following the interrupt processing routine for the A/D conversion, or relying upon a different interrupt processing routine which is effected at a predetermined interval of time, the CPU 60 executes the processing as illustrated in FIG. 3. First, at a point 80, the CPU 60 discriminates whether the air-fuel ratio is being controlled by a closed-loop or not. When the air-fuel ratio is controlled by an open-loop, the program jumps over all of the subsequent points in FIG. 3 to complete the interrupt processing. When the air-fuel ratio is controlled by a closed-loop, the program proceeds to a point 81 where a detection data from the $O_2$ sensor 31 is read out from the RAM 76. Then, at a point 82, the CPU 60 compares the detection data with a predetermined reference value to discriminate whether the concentration of oxygen in the exhaust gas is smaller than a stoichiometric concentration, i.e., whether the air-fuel ratio of the air-fuel mixture in the engine is on the rich side or the lean side relative to the stoichiometric air-fuel ratio. The rich flag is set to "1" when the air-fuel ratio condition of the engine is on the rich side, and is set to "0" when the air-fuel ratio condition of the engine is on the lean side. At a point 83, the state of the rich flag is discriminated. When the rich flag is "1", the program proceeds to a point 84 where an air-fuel ratio correction coefficient $f_i(A/F)$ is decreased by a predetermined value $\alpha$ as compared with the correction coefficient $f_{i-1}(A/F)$ in the previous operation cycle. Namely, at the point 84, the CPU 60 performs the calculation $f_i(A/F)=f_{i-1}(A/F)-\alpha$. When the rich flag is "0", the program proceeds to a point 85 to obtain an air-fuel ratio correction coefficient $f_i(A/F)$ which is greater than the coefficient $f_{i-1}(A/F)$ by a predetermined value $\beta$. Namely, at the point 85, the CPU 60 performs the calculation $f_i(A/F)=f_{i-1}(A/F)+\beta$. The obtained air-fuel ratio correction coefficient $f_i(A/F)$ is stored in a predetermined region in the RAM 76 at a point 86. When the rich flag that was "1" in the previous operation cycle is now "0" in the operation cycle of this time, or vice versa, a processing (skip processing) may be effected to greatly increase or decrease the coefficient $f_i(A/F)$ in the operation of this time.

The program then proceeds to a point 87 where it is discriminated whether the present operating condition of the engine is the second operating condition or not, i.e., whether or not the engine is under such operating conditions that the average value of the air-fuel ratio correction coefficients can be calculated. The second operating condition of the engine may be defined as an operating condition where the following conditions of (A) and/or (B) are established. In another modification of the present invention, the second operating condition may be defined as operating conditions where the following conditions of (C) to (F) are stepwise established, one after another in addition to the conditions of (A) and (B). Namely, the second operating condition may be an operating condition where the following condition of (A), (B), (A) and (B), (A) to (C), (A) to (D), (A) to (E), or (A) to (F) is established.

(A) The coolant temperature of the engine is higher than a predetermined temperature.

(B) The fuel enrichment operation is not carried out.

(C) The throttle valve is not fully closed, or the throttle valve is fully closed but the rotational speed of the engine is lower than a predetermined speed.

(D) The rotational speed of the engine is within a predetermined range, for example, within a range of 800 r.p.m. to 4,000 r.p.m.

(E) The flow rate of the air sucked into the engine is within a predetermined range, for example, within a range of 50 $m^3$/hr to 150 $m^3$/hr.

(F) The load of the engine is within a predetermined range, i.e., a basic fuel-injection pulse-width $\tau_0$ which corresponds to the load of the engine ranges from 3 msec to 8 msec.

The second operating condition is defined by the condition of (A) because of the reasons mentioned below. Since the warm-up enrichment is executed when the coolant temperature is low, even when the air-fuel ratio is controlled by a closed-loop, the air-fuel ratio correction coefficient $f_i(A/F)$ is maintained at a considerably small value. Therefore, if the average value $F_1(A/F)$ of the air-fuel ratio correction coefficients is calculated under such a condition, the calculated average value tends to be greatly deviated from the air-fuel ratio correction coefficient under an ordinary operation condition after the engine is fully warmed up. According to the method of the present invention, therefore, the average coefficient $F_i(A/F)$ is calculated only when the warm-up enrichment is stopped after the engine has been fully warmed-up. Here, the data related to the coolant temperature is temporarily stored in the RAM 76 via the A/D converter 54, as mentioned above. Therefore, it is easy to compare the stored data with the predetermined value to discriminate whether or not the engine is in this operating condition.

When the second operating condition is defined by the condition of (B), it is nearly the same as the condition of (A). Whether the enrichment operation is carried out or not can be easily discriminated depending upon whether the total fuel increment correction coefficient R is 1.0 or not, which coefficient R is employed in the interrupt processing program for calculating the fuel-injection pulse-width, that will be mentioned later.

When the second operating condition is defined by the condition of (C), the air-fuel ratio correction coefficient assumes a value which is different from an ordinary value, when the rotational speed of the engine is high and when the throttle valve is located at the fully closed position. Whether the throttle valve is fully closed or not can be discriminated from the full closed signal applied to the input port 64, and whether the rotational speed is higher than a predetermined speed or not can be easily found from the data related to the rotation speed of the engine.

The other conditions (D), (E), and (F) are employed since the air-fuel ratio correction coefficient differs from ordinary values when the engine is operated under the conditions the full outside the above conditions of (D), (E) and (F). The basic fuel-injection pulse-width $\tau_0$ is calculated in the interrupt processing program for calculating the fuel-injection pulse-width that will be mentioned later, and whether the load lies within the predetermined range is discriminated depending upon whether the calculated value $\tau_0$ falls within the predetermined range or not.

When it is discriminated at a point 87 that the engine is in the second operating condition, the program proceeds to a point 88 where an averge value $F_i(A/F)$ of the air-fuel ratio correction coefficients is calculated. The average value $F_i(A/F)$ can be calculated according to the following relation, using an average value $F_{i-1}(A/F)$ that was calculated in the previous time, $$F_i(A/F) = \frac{A}{A+B} f_i(A/F) + \frac{B}{A+B} F_{i-1}(A/F)$$

where A and B denote constants. The average value $F_i(A/F)$ can be also calculated according to the following relation, employing the air-fuel ratio correction coefficients $f_i(A/F)$, $f_{i-1}(A/F)$, $f_{i-2}(A/F)$, . . . , $f_0(A/F)$ in the present and preceding operation cycles, $$F_i(A/F) = \frac{f_i(A/F) + f_{i-1}(A/F) + \ldots + f_0(A/F)}{i+1}$$

Then, at a point 8a, the calculated average value $F_i(A/F)$ is stored in a predetermined region of the RAM 76 to complete the interrupt processing of FIG. 3.

When it is discriminated at the point 87 that the engine is not in the second operating condition, the interrupt processing is finished without calculating or renewing the average value.

Figure 4:
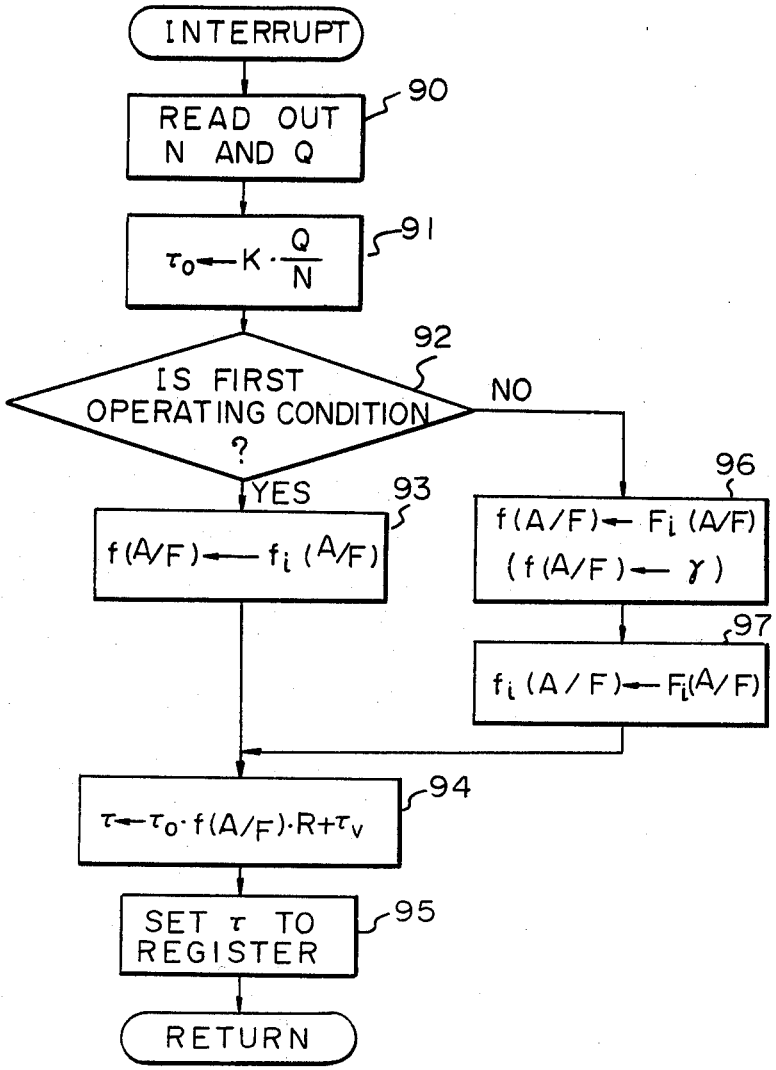

As an interrupt request signal produced at every crank angle of 360° is introduced via the line 40b, on the other hand, the CPU 60 executes the interrupt processing routine for calculating the fuel-injection pulse-width, as shown in FIG. 4. First, at a point 90 the CPU 60 reads out from the RAM 76 the data related to the flow rate Q of the intake air and the rotational speed N, and at a point 91 calculates a basic fuel-injection pulse-width $\tau_0$ of the fuel injection signal to be applied to the fuel injection valve 24 according to the following relation, $$\tau_0=(K\cdot Q/N)$$

where K is a constant.

Then, at a point 92, the CPU 60 discriminates whether the present operation condition of the engine is under the first operating condition or not, i.e., whether the air-fuel ratio should be controlled by a closed-loop or not. As mentioned earlier, the first operating condition, generally, is defined by the condition in which the coolant temperature of the engine is higher than a predetermined temperature (which is lower than a predetermined temperature defined by the condition of (A) under the second operating condition), the opening degree of the throttle valve is not so great as will have to additionally increase the rate of feeding the fuel, and the fuel has not been cut off.

When it is discriminated at the point 92 that the engine is under the first operating condition, the program proceeds to a point 93 where the coefficient f(A/F) that will be used in the operation in the next point 94 is set to $f(A/F)\leftarrow f_i(A/F)$. Then, the pulse-width $\tau$ is calculated at the point 94 according to the following relation, $$\tau=\tau_0\cdot f(A/F)\cdot R+\tau_v$$

where R denotes a total fuel increment correction coefficient for increasing the rate of feeding the fuel when the engine is being warmed up, started or accelerated, and $\tau_v$ denotes a value that corresponds to an ineffective injection time of the fuel injection valve 24.

The calculated data which corresponds to the fuel-injection pulse-width $\tau$ is set, at a point 95, to the output register of the fuel injection control circuit 58, whereby the interrupt processing routine of this time is completed. Thus, when the first operating condition is to be continued, the air-fuel ratio correction coefficient $f_i(A/F)$, which is calculated at the point 84 or 85 by the processing routine of FIG. 3, is used for calculating the fuel-injection pulse-width $\tau$, and the air-fuel ratio is controlled by a closed-loop in an ordinary manner.

When it is discriminated at the point 92 that the engine is not under the first operating condition, the program proceeds to points 96 and 97. At the point 96, first, the coefficient f(A/F) is equalized to the average value $F_f(A/F)$ that was calculated at the point 88 by the processing routine of FIG. 3. Namely, at the point 96, the operation $f(A/F)\leftarrow F_f(A/F)$ is carried out. at the point 97, the coefficient $f_i(A/F)$ is equalized to the above average value $F_f(A/F)$. Namely, at the point 97, the operation $f_i(A/F)\leftarrow F_f(A/F)$ is carried out. In this case, therefore, the correction coefficient f(A/F) used for calculating the pulse-width $\tau$ is fixed to the average value $F_f(A/F)$ at which the air-fuel ratio is controlled by an open-loop. As the engine assumes the first operating condition again, the air-fuel ratio control is returned from open-loop control to closed-loop control. Here, since the coefficient $f_i(A/F)$ at the time when closed-loop control is resumed, has been set to be equal to $F_f(A/F)$, the initial correction coefficient f(A/F) used for calculating the injection pulse-width $\tau$ becomes equal to the average value $F_f(A/F)$.

The contents to be processed by the point 96 may be $f(A/F)\leftarrow\gamma$ (where $\gamma$ is a constant). This makes it possible to fix the correction coefficient f(A/F) used for the calculation of the fuel injection pulse-width $\tau$ during open-loop control, to a predetermined value $\gamma$.

Figure 5:
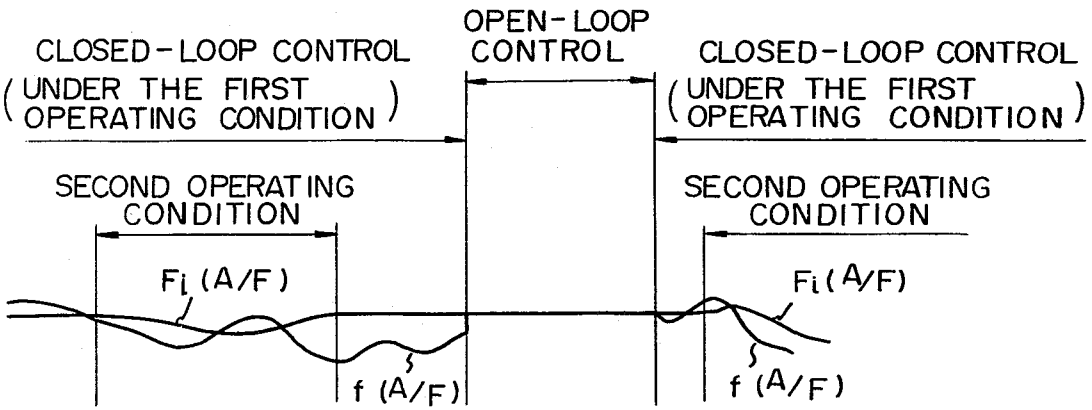
FIG. 5 is a graph for illustrating the mode of operation of the control circuit shown in FIG. 2.

FIG. 5 illustrates the operation according to the embodiment of the present invention. It will be obvious from FIG. 5 that the air-fuel ratio correction coefficient f(A/F) used for the calculation of fuel-injection pulse-width $\tau$ is varied responsive to the detection signals of the $O_2$ sensor when the engine is under the first operating condition, and the air-fuel ratio is controlled by a closed-loop. When the engine is not under the first operating condition, however, the air-fuel ratio correction coefficient f(A/F) is fixed to a value that is equal to the average value $F_f(A/F)$, and the air-fuel ratio is controlled by an open-loop. The initial coefficient f(A/F) when closed-loop control is to be resumed, is also controlled so as to become equal to the average value $F_f(A/F)$. Further, the average value $F_f(A/F)$ is renewed and is allowed to change only when the engine is under the second operating condition, but is not renewed when the engine is under other operating conditions. The second operating condition has been set so as to fall in the first operating condition, i.e., to fall in the condition in which the air-fuel ratio is controlled by a closed-loop. According to the present invention, therefore, the air-fuel ratio correction coefficient is allowed to reach an optimum value within short periods of time when closed-loop control is resumed. Consequently, performance for controlling the air-fuel ratio can be enhanced, operation characteristics can be enhanced, and the function of cleaning exhaust gas can be improved.

In the aforementioned embodiment, the interrupt processing routine for calculating the fuel-injection pulse-width is executed at every crank angle of 360°. The interrupt processing routine, however, may also be executed at a predetermined interval of time.

As many widely different embodiments of the present invention may be constructed without departing from the spirit and scope of the present invention, it should be understood that the present invention is not limited to the specific embodiments described in this specification, except as defined in the appended claims.

We claim:

1. An air-fuel ratio control method of an internal combustion engine, comprising the steps of:

detecting the concentration of a predetermined component in the exhaust gas in the engine;

detecting the operating condition of the engine to discriminate whether or not the engine is in a predetermined first operating condition;

calculating an air-fuel ratio correction coefficient depending upon said detected concentration, when the engine is in the first operating condition;

holding an air-fuel ratio correction coefficient to a value, when the engine is not in the first operating condition;

detecting the operating condition of the engine to discriminate whether or not the engine is in a predetermined second operating condition which is included within said first operating condition;

calculating an average value of said calculated air-fuel ratio correction coefficient only when the engine is in the second operating condition; and correcting the amount of fuel supplied to the engine in accordance with said air-fuel ratio correction coefficient, said correcting being performed by a closed-loop control when the engine is in the first operating condition and performed by an open-loop control when the engine is not in the first operating condition, an initial value of the air-fuel ratio correction coefficient when said fuel correction changes from open-loop control to closed-loop control being determined according to said calculated average value.

2. A method as claimed in claim 1, wherein said holding step includes a step of holding an air-fuel ratio correction coefficient to a predetermined constant value, when the engine is not in the first operating condition.

3. A method as claimed in claim 1, wherein said holding step includes a step of holding an air-fuel ratio correction coefficient to said calculated average value, when the engine is not in the first operating condition.

4. A method as claimed in claim 1, wherein said average value calculating step includes a step of calculating an average value from the presently calculated air-fuel ratio correction coefficient and from the last calculated average value.

5. A method as claimed in claim 1, wherein said average value calculating step includes a step of calculating an average value of the presently and previously calculated air-fuel ratio correction coefficients.

6. A method as claimed in claim 1, wherein said engine has a throttle valve and a concentration sensor for detecting a predetermined component in the exhaust gas, and said first operating condition is determined to be a condition where the coolant temperature of the engine is higher than a predetermined temperature, the opening degree of the throttle valve is smaller than a predetermined degree, the concentration sensor is active and the fuel cut operation is not carried out.

7. A method as claimed in claim 1, wherein said second operating condition is determined to be a condition where the cooltant temperature of the engine is higher than a predetermined temperature and the fuel enrichment operation is not carried out.

8. A method as claimed in claim 7, wherein said engine has a throttle valve and said condition to which said second operating condition is determined further includes a condition that the throttle valve is not fully closed or that the throttle valve is fully closed, but the rotational speed of the engine is lower than a predetermined speed.

9. A method as claimed in claim 8, wherein said condition to which said second operating condition is determined further includes a condition that the rotational speed of the engine is within a predetermined range.

10. A method as claimed in claim 9, wherein said condition to which said second operating condition is determined further includes a condition where the flow rate of air sucked into the engine is within a predetermined range.

11. A method as claimed in claim 10, wherein said condition to which said second operating condition is determined further includes a condition where the load of the engine is within a predetermined range.

12. Apparatus for controlling the air-fuel ratio in an internal combustion engine, comprising:

means for detecting the concentration of a predetermined component in the exhaust gas in said engine;

means for detecting the operating condition of said engine to discriminate whether or not the engine is in a predetermined first operating condition;

means for detecting the operating condition of said engine to discriminate whether or not said engine is in a predetermined second operating condition which is included within said first operating condition;

processing means, responsive to said concentration detecting means, said first operating condition correcting means and said second operating condition correcting means, said processing means for (1) determining an air-fuel ratio correction coefficient depending upon said detected concentration, when the engine is in the first operating condition; (2) holding an air-fuel ratio correction coefficient to a value, when the engine is not in the first operating condition; and (3) determining an average value of said calculated air-fuel ratio correction coefficient only when the engine is in said second operating condition, said average value being employed to control said air-fuel ratio when said fuel correction changes from open-loop control to closed-loop control; and means for correcting the amount of fuel supplied to the engine in accordance with said air-fuel ratio correction coefficient.

13. Apparatus as in claim 12, wherein said processing means holds an air-fuel ratio correction coefficient to a predetermined constant value, when the engine is not in the first operating condition.

14. Apparatus as in claim 12, wherein said process means holds an air-fuel correction coefficient to said calculated average value, when the engine is not in the first operating condition.

15. Apparatus as in claim 12, wherein said processing means calculates said average value from the presently calculated air-fuel ratio correction coefficient and from the last calculated average value.

16. Apparatus as in claim 12, wherein said processing means calculates said average value of the presently and previously calculated air-fuel ratio correction coefficients.

17. Apparatus as in claim 12, wherein:

said engine includes a throttle valve; and said first operating condition detecting means includes means for determining whether: (1) the coolant temperature of the engine is higher than a predetermined temperature, (2) the opening degree of the throttle valve is smaller than a predetermined degree, (3) the concentration detecting means is active and (4) the fuel cut operation is not carried out.

18. Apparatus as in claim 12, wherein said second operating condition detecting means includes means for determining whether the coolant temperature of the engine is higher than a predetermined temperature and the fuel enrichment operation is not carried out.

19. Apparatus as in claim 18, wherein:

said engine includes a throttle valve and said second operating condition determining means includes means for determining whether one of the throttle valve is not fully closed and the throttle valve is fully closed, but the rotational speed of the engine is lower than a predetermined speed.

20. Apparatus as in claim 19, wherein said second operating condition determining means includes means for determining whether the rotational speed of the engine is within a predetermined range.

21. Apparatus as in claim 20, wherein said second operating condition determining means includes means for determining whether the flow rate of air sucked into the engine is within a predetermined range.

22. Apparatus as in claim 21, wherein said second operating condition determining means includes means for determining whether the load of the engine is within a predetermined range.

* * * * *